United States Patent [19]

Fischer

[11] 4,368,986

[45] Jan. 18, 1983

[54] DUAL SHELL BLENDER WITH INTENSIFIER

[75] Inventor: John J. Fischer, Stroudsburg, Pa.

[73] Assignee: Harsco Corporation, Camp Hill, Pa.

[21] Appl. No.: 194,406

[22] Filed: Oct. 6, 1980

[51] Int. Cl.[3] ..... B01F 9/08

[52] U.S. Cl. ..... 366/170; 366/224; 366/232

[58] Field of Search ..... 366/170, 169, 222, 223, 366/224, 232, 325, 327, 235, 329

[56] References Cited

U.S. PATENT DOCUMENTS

| | | | |
|---|---|---|---|
| 1,074,397 | 9/1913 | Westby | 366/327 |
| 2,235,604 | 3/1941 | Brumagim | 366/329 |
| 2,514,126 | 7/1950 | Fischer | 366/220 |
| 2,677,534 | 5/1954 | Fischer et al. | 366/235 |
| 2,890,027 | 6/1959 | Fischer | 366/170 |
| 3,341,182 | 9/1967 | Fischer | 366/233 X |
| 3,362,688 | 1/1968 | Fischer | 366/170 |
| 3,400,185 | 9/1968 | Kohnle et al. | 366/224 |
| 3,635,443 | 1/1972 | Fischer | 366/173 |
| 3,787,035 | 1/1974 | Bryson, Jr. et al. | 366/232 X |
| 3,986,705 | 10/1976 | Nauta | 366/169 |
| 4,141,657 | 2/1979 | Fischer | 366/232 |

FOREIGN PATENT DOCUMENTS

| | | | |
|---|---|---|---|
| 15871 | 5/1902 | Sweden | 366/329 |

OTHER PUBLICATIONS

Patterson-Kelly Co., *Patterns of Precision in Processing Equipment*, Copyright 1976, p. 11.

*Chemical Engineering*, Aug. 8, 1960, McGraw Hill, p. 125.

*P-K Cross-Flon Bulletin*, Bul. CF-2, Patterson-Kelly Co., pp. 1-2.

*A Continuous Whirl of Solids Processing Developments*, Patterson-Kelly Co., cover page & pp. 1-2.

*Primary Examiner*—Philip R. Coe

*Attorney, Agent, or Firm*—Kerkam, Stowell, Kondracki & Clarke

[57] ABSTRACT

Disclosed is a dual shell blender having a liquid dispersion intensifier assembly or agitator which extends in only one of two legs of the blender. The intensifier assembly includes a single assembly of discs adapted to be rotated at a high rate of speed relative to the blender. An intensifier drive shaft and blender drive shaft are coaxial such that the intensifier assembly and blender rotate about a common axis of rotation, with the speed of rotation of each being selectively controlled. The intensifier assembly includes at least two L shape pitched rods symmetric with respect to the axis of rotation which throw material within one shell towards a plane formed by the juncture of the two legs. When the apex of the blender is rotated to its highest position, the projected materials will be thrown across the common juncture plane into the other leg. When the apex of the blender is rotated to its lowest position the materials projected by the L shape rods will be deflected by the inner wall of the leg such that these materials will be moved away from the common juncture plane.

14 Claims, 7 Drawing Figures

82
90
91
89
87A
86A
76
88A
84
64
92
98A
48
96
88B
86B
87B
106
100
102
104
98B
10
114A
112
110
128B
116
114B
118A
108
118B
130
126A
126B
124A
128A
120
122
124B
3
3
90
138
132B
136
108
10
150
14
140
12
90
76
146
148
66
64
134
132A
108
10
14
142
12
144

DUAL SHELL BLENDER WITH INTENSIFIER

CROSS REFERENCE TO RELATED APPLICATIONS

This invention is an improvement on the blending apparatus illustrated and described in U.S. Pat. No. 4,141,657 the subject matter of which is hereby incorporated by reference.

BACKGROUND OF THE INVENTION

1. Field of the Invention

This invention relates to material mixing or blender devices for use in various industries, and more particularly to such apparatus as intended for use in solid-solids or liquid-solids blending operations. More specifically, the present invention relates to a novel agitator or intensifier.

2. Description of the Prior Art

In the prior art, various type mixers or blenders have been developed for use in blending solid-solids or liquids-solids to achieve dry or wet blends of materials. These prior art mixers and blenders have comprised variously shaped tumbler devices with or without internal baffles, agitators, intensifiers or the like and as liquid dispersion or attrition bars.

One such prior art blender is known as a cone or double cone blender. This blender derives its name from its shape and comprises a vertical cylinder with conical ends which rotate about a horizontal axis. The double cone blender suffers from the disadvantage of symmetrical flow pattern with maximum flow at the center. This tends to fill the space mostly from the middle, leaving the material near the trunnion relatively unmixed. Consequently, excessively long mixing periods are required for blending because of poor axial flow of materials.

Another form of solid-solids blender known in the art is a ribbon blender. Such blender comprises a stationary trough-type shell fitted with longitudinal shaft on which are mounted arms supporting slender spiral ribbons. It is one of the oldest mechanical mixing devices used for solid-solids mixing. This blender is effectively used for low-density solids, materials that aerate readily and light pastes. It is not recommended for precision blending, abrasive materials, material that packs, or when frequent cleaning is required. It is also not suitable for dense materials because of excessive power requirements. Unmixed material tends to accumulate at ends and at shell wall because of blade clearance. Ribbon blenders also suffer from the disadvantage of poor axial flow of materials.

Still another form of blender is my blender developed in the late 1940's and patented July 4, 1950, under U.S. Pat. No. 2,514,126, herewith incorporated by reference. This blender comprises two opposed simple cylinders formed into a "V". An outgrowth of the simple cylinder, the dual shell blender overcomes discharge problems and creates additional mixing action at the center. This extra action is responsible for faster, more efficient blending action than produced by a single cylinder and relies for its primary mixing action on intermeshing of solids at the center line.

A modification of the above-noted patent includes an agitator or intensifier as is disclosed in U.S. Pat. No. 2,677,534, issued May 4, 1954. As described therein, the agitator is turned at a very high rate of speed relative to the rotation speed of the blender itself and, thereby, effects dispersion of the materials within the blender.

In a further improvement of the dual shell blender with intensifier, the intensifier may include channel outlets through which liquid may be dispersed into the blender. Such an arrangement is shown for example in the publication "Patterns of Precision in Processing Equipment", copyright 1976 by Patterson Kelly Co., a division of Harsco Corporation and assignee of the present invention. Use of such a liquid adding intensifier provides a convenient technique for blending liquids and solids. The use of such liquid dispersion intensifiers is also disclosed in my U.S. Pat. No. 2,890,027, issued June 9, 1959, U.S. Pat. No. 3,362,688, issued Jan. 9, 1968 and U.S. Pat. No. 3,635,443 issued Jan. 18, 1972, which patents are herewith incorporated by reference.

Another patented improvement to the basic dual shell blender is disclosed in my aforesaid U.S. Pat. No. 4,141,657, issued Feb. 27, 1979. That patent discloses a modified dual shell blender wherein one of the legs has a different length than the other leg. Such disparity in the lengths of the legs was found to produce a surprisingly synergistic action which dramatically reduced the mixing time over that normally experienced with dual shell blenders having legs of the same length.

As previously noted, the use of liquid dispersion intensifiers with blenders is known to the art. Such intensifiers may include a plurality of canted disc assemblies, at least one disc assembly located in each of the moving chambers of the blender. The canted disc assemblies have dispersion blades and the intensifier is disposed such that the slant in each disc is asymmetric with respect to the axis of intensifier rotation i.e. each point on the circumference of the disc will not be tracking the point 180° around on the circumference, but instead will be aerating an area axially removed within the blender. Because each point on the circumference of the canted disc is aerating or "plowing through" an area different from the other circumferential points, more power is required than would otherwise be the case. Furthermore, this asymmetry of the canted disc design makes great care and precision necessary in balancing the intensifier. Additionally, the use of a plurality of disc assemblies requires a complicated and costly shaft construction to ensure equal liquid flow patterns through each disc assembly.

In contrast to the relatively high power required for driving a canted disc intensifier, an intensifier which is symmetric with respect to the axis of rotation will require low power. Such an intensifier construction is shown in the above mentioned U.S. Pat. Nos. 2,677,534 and 3,635,443 wherein the intensifier is symmetric with respect to the axis of rotation. Each circumferential point on the intensifier shaft and on each one of paddles follows in the path of rotation of at least one other point on the intensifier. Accordingly, less power is required than for the asymmetric intensifier arrangement; However, the symmetric intensifier arrangement tends to throw material directly radially outward. This is disadvantageous because it tends to impede the flow of material from one leg to the other leg.

While the addition of liquid dispersion intensifiers into dual shell blenders provides a generally efficient method of combining liquids and solids, the use of a symmetrical high intensifier is disadvantageous since it tends to work against the desirable flow of materials from one leg of the blender to the other leg. On the other hand, where a canted disc assembly or other asymmetric intensifier does not adversely affect the cross flow of materials as much as a symmetrical intensifier does, such an intensifier consumes greater amounts of power and requires more precision in balancing than a symmetrical intensifier. Both of the latter types of intensifier also require placement of individual disc assemblies in each shell.

SUMMARY OF THE INVENTION

The foregoing disadvantages of prior art blenders are overcome by the present invention wherein an intensifier bar construction is provided which has both the low power advantage of the symmetric intensifier and the good axial flow characteristic associated with the asymmetric intensifier, while minimizing the complexity of the structure of the fluid supply channels of the supporting shaft.

Accordingly, it is an object of the present invention to provide an improved solid and/or liquid dispersion intensifier.

Another object of the invention is to provide a relatively low power consumption blender including an intensifier.

A further object of the invention is to provide an improved solids-solids or liquids-solids blender which is relatively simple in construction and does not require extensive and costly machining and balancing techniques.

Still another object of the invention is to provide an improved blender with intensifier which is subject to reduced wear and maintenance.

These and other objects of the present invention are achieved by the use of a dual shell blender having a liquid dispersion intensifier which is supported cantilever fashion and extends in only one of the two shells of the blender. The intensifier includes a single disc assembly adapted to be rotated at a very high rate of speed independently and relative to the rotational speed of the shells. An intensifier drive shaft and blender drive shaft are arranged coaxially such that the intensifier and blender rotate about a common axis of rotation. The intensifier includes at least two L shaped rods disposed at an angle of about 45° with respect to the axis of rotation. As the shells and intensifier are rotated, the rods cause materials within the shell in which the disc assembly is positioned to be thrown upward with respect to the horizontal axis of rotation of the shells towards the juncture plane of the two legs. When the apex of the blender is in its highest position, the projected materials will be thrown across the common juncture plane into the other leg. When the apex of the blender is in its lowest position, the projected materials will be deflected by the inner wall of the leg such that these materials will be moved away from the common juncture plane. The L shaped rods are symmetrically disposed with respect to the axis of rotation and pitched at an angle with respect to the angle of rotation such that a minimum amount of power is consumed.

BRIEF DESCRIPTION OF THE DRAWINGS

Other objects and advantages of the present invention and the attendant advantages will be readily apparent from the following specification, especially when taken in connection with the appended drawings in which.

Figure 3:
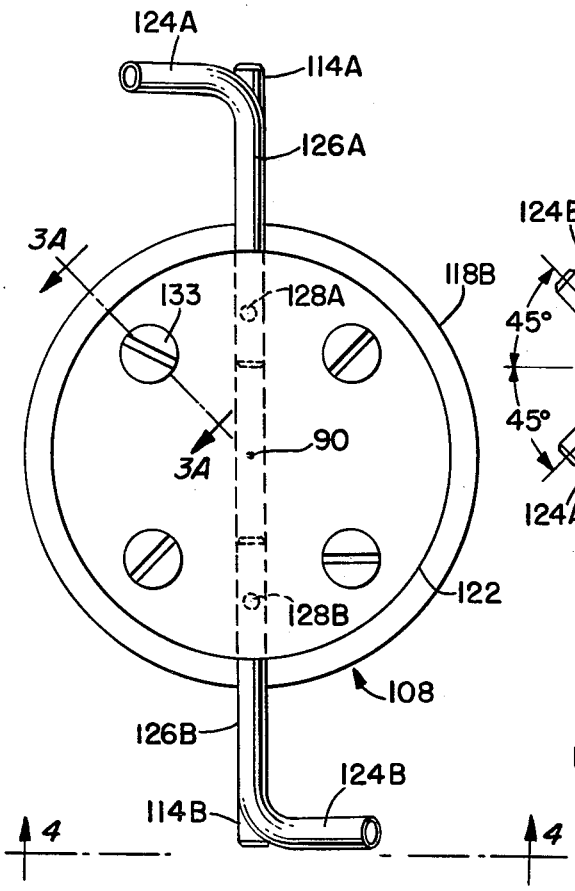
FIG. 3 is an end view of the intensifier of the present invention taken along lines 3—3 of FIG. 2.

FIG. *3a* is a cross sectional view taken along lines *3a*—*3a* of FIG. 3.

Figure 4:
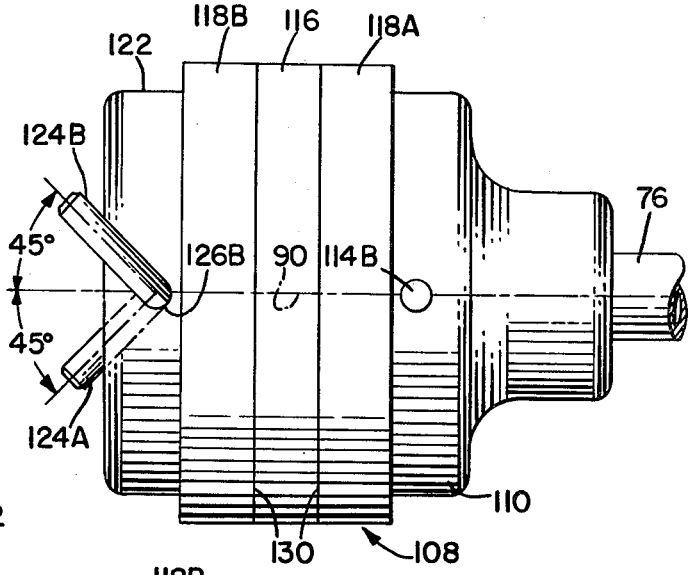

FIG. 4 is a bottom view of the intensifier taken along lines 4—4 of FIG. 3.

FIG. *5a* and FIG. *5b* illustrate the principles of operation of the present invention when used in connection with a dual shell blender having legs of different axial length.

DESCRIPTION OF PREFERRED EMBODIMENTS

Figure 1:
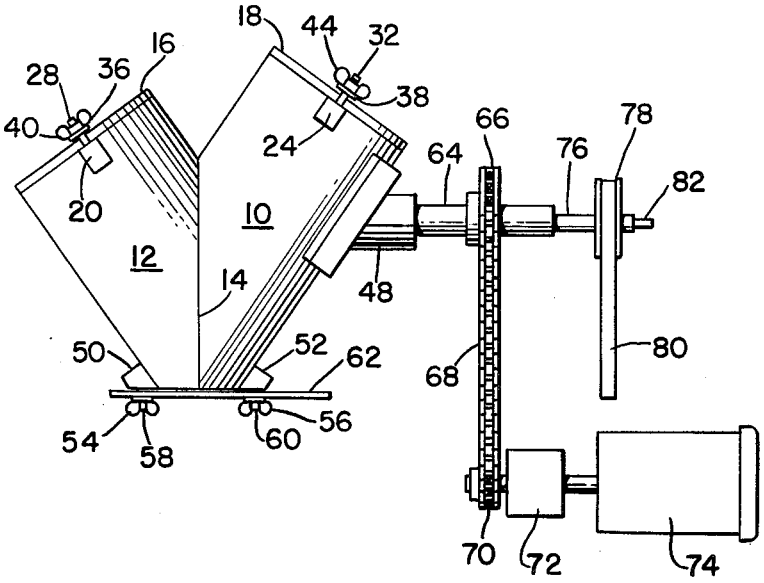
FIG. 1 is a side view of a blending mill in accordance with the present invention.

Referring now to FIG. 1 there is shown a dual shell blender of the type shown in my aforenoted U.S. Pat. No. 4,141,657, wherein the blender includes shells or legs 10 and 12, which have different lengths. While the blender is illustrated and described herein in connection with a dual shell blender of the type having different length legs, it will be apparent to those skilled in the art that the intensifier assembly of the present invention can be incorporated in a dual shell blender of the type shown and illustrated in my earlier U.S. Pat. No. 2,514,126. The two legs 10 and 12 of the blender are welded or otherwise connected together at common juncture plane 14.

Preferably, the ratio of the length of the two cylinders is approximately 4:3 such that the volume or capacity of one cylinder is approximately 35% greater than the other cylinder. Both leg portions 10, 12 are of hollow, frustocylindrical form relatively disposed with their cylinder axes intersecting. The common plane of the juncture between the cylinder legs 10, 12 is, as indicated at 14, disposed at an acute angle of approximately 35° to 45° to the longitudinal cylinder axis of each leg. For a blender with legs of unequal length the angle is 35°. For a dual shell blender, the angle is preferably 40°. It should be noted that inasmuch as such blenders are frequently used in blending of pharmaceuticals, cosmetics of food products, the cylinders are preferably formed of stainless steel. However, the cylinders may be formed of other materials, either metal or plastic, in which case the juncture connection between opposite leg portions is joined by a process compatible with the material used.

The outer end of each cylinder 10, 12 is closed by suitable removable end plate or cover plate such as indicated at 16, 18, respectively. To this end, there is provided at opposite sides of each cylinder 10, 12 and adjacent its open end a pair of cooperating stud supports 20 and 24 for supporting, respectively, upward extending threaded studs 28 and 32. To lock the covers in place, cross bars 36 and 38, which extend to similar studs and supports on the side not shown as illustrated in U.S. Pat. No. 4,141,657, are provided. Bars 36, 38 include transversely spaced openings or slots to allow the cross bars to be positioned over the associated end plate or cover and are firmly held in place by threaded wing nuts 40 and 44, as the case may be. Removal of either cover plate allows complete access to the interior of the cylinder for maintenance as well as loading of the interior blending space with materials.

Bottom cover plate 62 is mounted at the apex of the blender and is held in position by stud supports 50 and 52, studs 58 and 60 which extend through holes in the bottom plate 62, and wing nuts 54 and 56 which secure plate 62 to the blunted apex of legs 10 and 12. Alternately, the configuration of the apex could be a collartype apex as shown in the above mentioned U.S. Pat. Nos. 2,514,126, 2,677,534, 2,890,027 and 4,141,657.

As shown in FIG. 1, the dual shells 10, 12 are supported cantilever fashion by means of an external trunion 48 which is connected to a shell drive sprocket or sheave 66 by way of shell drive shaft 64. Shell drive belt 68 transmits power to sprocket 66 from motor 74 by way of gear train 72 and sprocket 70. Coaxially extending through the shell drive shaft 64 is the intensifier drive shaft 76, upon which intensifier drive sprocket 78 is mounted. Intensifier drive belt 80, which is shown partially broken away, is used to couple energy from an intensifier drive motor. For clarity sake, the intensifier drive motor is not shown in FIG. 1, since it would be located behind the shell drive motor 74. It should be appreciated that the intensifier drive system may be arranged similar to the motor 74, gear train 72, and sprocket 70 arrangement for the shell drive with the intensifier, of course, rotating at a much higher rate of speed than the shell or blender itself. Extending out of the intensifier drive shaft 76 is a liquid feed tube 82, which provides liquid to the intensifier as will be described in more detail in connection with FIG. 2. It will be appreciated that shell drive shaft 64 will be supported by means which allow it free rotation, while restraining up, down or side movements. An exemplary arrangement is shown in the U.S. Pat. No. 4,141,657 and need not be discussed in detail herein. Drive belts 68 and 80 may be covered by a suitable housing such as that disclosed in U.S. Pat. No. 4,141,657.

Figures 2, 5A, 5B:
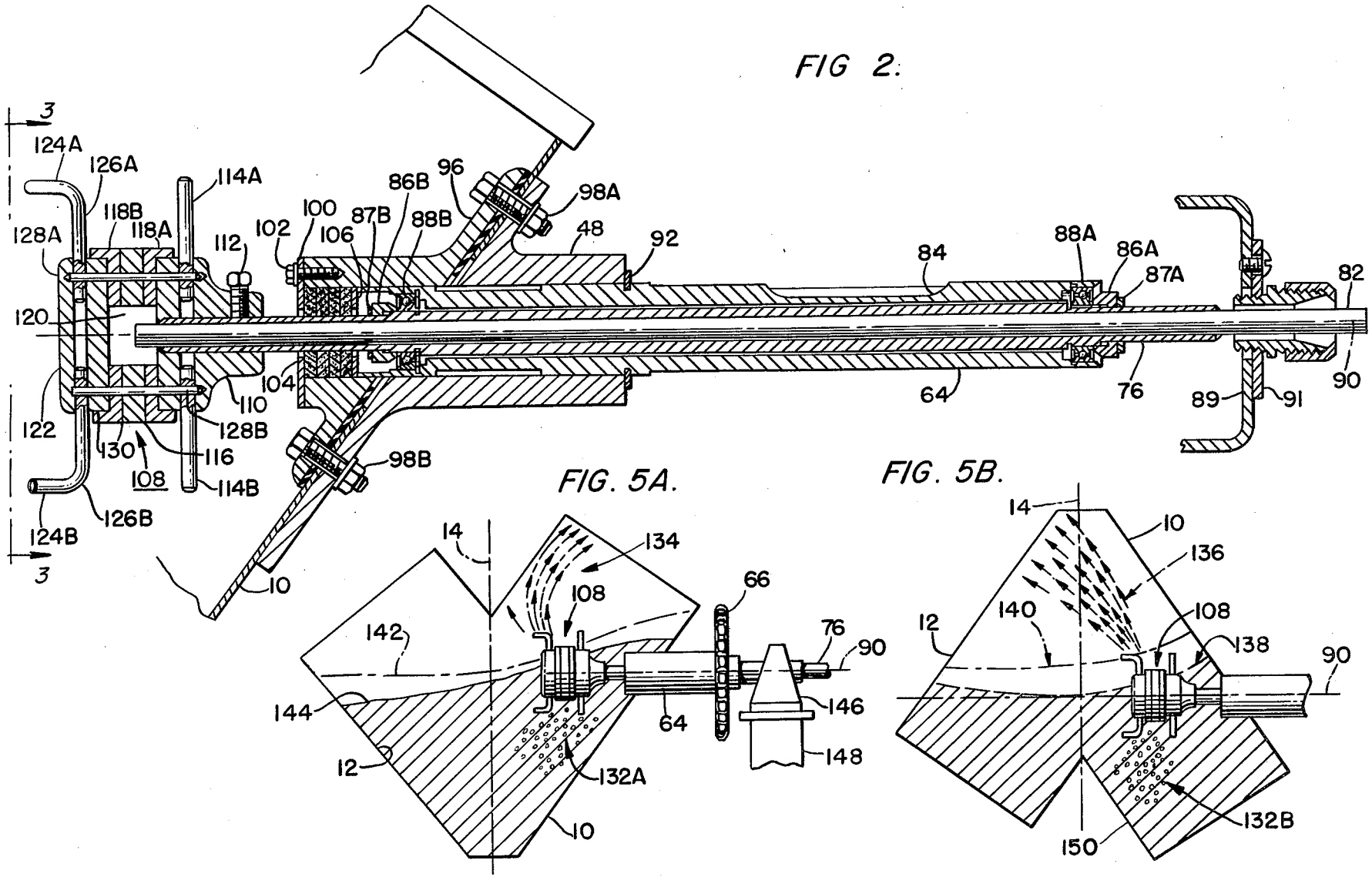
FIG. 2 is a cross sectional view of the intensifier and intensifier drive arrangement of the present invention.

FIG. 2 shows a side view in cross section of the intensifier and associated drive arrangement of the present invention. The center line 90 of the intensifier drive shaft 76 and the coaxial shell or blender drive shaft 64 also represents the axis of rotation of both the shell and the intensifier. Extending throughout the full length of intensifier drive shaft 76, and positioned coaxially with respect that drive shaft, is liquid feed tube 82. The liquid feed tube 82 provides liquids to be mixed with solids in the blender, as discussed in detail below. Disposed near the outer end of liquid feed tube 82 are mounting bracket 89 and mounting plate 91.

Shell drive shaft 64 is rotatably mounted around intensifier drive shaft 76 by way of outer ball bearing assembly 88A and inner ball bearing assembly 88B. Spacer rings 86A and 86B and retaining rings 87A and 87B prevent axial movement between the two drive shafts. The shell drive sprocket 66 (not shown in FIG. 2) may be fixed into shell drive shaft 64 at indentation 84. If desired, a similar indentation may be used for securing the intensifier drive sprocket 78 (also not shown in FIG. 2) to intensifier drive shaft 76. An external retaining ring 92 securely holds shell drive shaft 64 in place with respect to external trunion 48. Bolt and nut combinations 98A and 98B securely hold external trunion 48 and internal trunion 96 to the shell and prevent both trunions from moving relative to the wall of leg 10. Four dacron felt seal rings 104 and associated silicon grease are disposed at the inner end of trunion 96 between trunion cover 100 and spacer 106. Cover 100 is held in place by screws or bolts such as 102.

Mounted on the inner end of intensifier drive shaft 76 is intensifier assembly 108 which includes a rear hub 110 secured to rotate with intensifier drive shaft 76 by way of set bolt 112. If desired, a plurality of such bolts may be angularly positioned around the hub 110. Straight dispersion rods 114A and 114B extend radially outward from the center line or axis of rotation 90. As shown, the two rods 114A and 114B are colinear. Disposed between the rear hub 110 and a front hub 122 is a disc assembly including a rear disc 118A, a center disc 116 and a front disc 118B. Liquid which is deposited into the interior 120 of the intensifier 108 by liquid feed tube 82 is dispersed into the blender by way of channel outlets 130. For convenience, only two of the outlets are shown, it being understood that a liquid dispersion outlet occurs at each disc-disc or disc-hub interface. The principles of operation of such liquid dispersion outlets are relatively well known and are described for example in the above mentioned U.S. Pat. No. 2,890,027. Accordingly, no detailed discussion of these outlets is necessary. However, it should be noted that each outlet 130 of intensifier 108 extends radially outward from axis of rotation 90, and, accordingly, the liquid dispersed at the channel corresponding to disc-hub interfaces is generally dispersed with an axial component (along center line or axis of rotation 90). Attached to front hub 122 are pitched L shape dispersion rods (two of which are shown) having shafts 126A and 126B and corresponding heads 124A and 124B. Each shaft 126A and 126B includes a hole through which corresponding locator pins 128A and 128B are positioned. The locator pins 128A and 128B also secure straight dispersion rods 114A and 114B in place, as shown. As noted, only two rods are shown. Depending on the size of the blender and the quantity and type of materials to be blended, more rods may be utilized, it only being necessary that they be uniformally spaced for balance.

The heads 124A and 124B are disposed, preferably, at a 45° angle with respect to the plane of shafts 126A and 126B and axis of rotation 90. Shafts 126A and 126B of the L shaped rods are coplanar with a plane defined by straight dispersion rods 114A and 114B and axis of rotation 90. Conceptually, head 124A extends into the plane of view for FIG. 2, whereas the head 124B extends out of the plane of view of FIG. 2.

FIG. 3 shows an end view of the intensifier assembly as taken along lines 3—3 of FIG. 2. Dispersion rods 114A and 114B are coplanar with the shafts 126A and 126B of the L shaped rods. Furthermore, the axis of rotation 90, which appears as a point of this end view, lies in the plane defined by the dispersion rods. The L shaped rods are pitched in that the ends 124A and 124B extend out of the plane defined by the shafts 126A and 126B of the L shaped dispersion rods and center line 90, preferably at an angle of 45°. A plurality of threaded studs 133 (only one is numbered in the drawing for simplicity) extend into the inner hub 122, whereas the locator pins 128A and 128B appear in phantom line in FIG. 3.

Figure 3A:
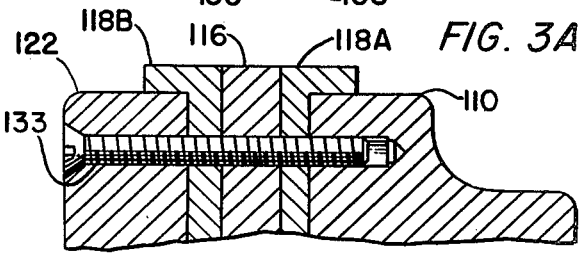

FIG. 3*a* shows a cross sectional break away taken along lines 3*a*—3*a* of FIG. 3. The threaded stud 133 secures the disc assembly together by extending through hub 122, disc 118B, center disc 116, disc 118A and hub 110.

FIG. 4 shows a side view of the intensifier assembly taken along lines 4—4 of FIG. 3. The plane of the dispersion rods (that plane defined by straight dispersion rods 114A and 114B and the shafts 126A and 126B of the L shaped rods) is coincident with the rotational axis 90 in the view of FIG. 4. Head 124B of the L shaped rod extends 45 degrees in one direction from the plane of the dispersion rods, whereas head 124A of the other L rod extends 45 degrees in the other direction from the plane of the dispersion rods. Further, head 124B is also pitched 45° in one direction from the plane defined by rotational axis 90 and shafts 126A and 126B, whereas head 124A is pitched 45° in the other direction from this same plane. It will of course be appreciated that in the preferred embodiment the plane defined by shafts 126A and 126B and the rotational axis 90 is the same as that defined by the dispersion rods and the rotational axis since the rods 114A and 114B are parallel to the shafts 126A and 126B of the L shaped rods.

Turning now to FIGS. 5A and 5B, the operation of the present invention will be discussed. As shown in simplified form, shell drive shaft 64 is rotatably supported by lug 146 mounted on stand 148. Intensifier drive shaft 76 is coaxially mounted within the shell or blender drive shaft 64. Both of the drive shafts rotate about a common axis of rotation 90. The shell, consisting of legs 10 and 12, is shown filled with a solid material to be blended and is driven at a relatively low rate of speed through drive sprocket 66. Intensifier 108 is rotated about the same axis at a relatively high rate of speed, thereby blending solid materials which have been placed in the blender along with liquid which is applied through channels 130 (FIGS. 2–4) of the intensifier 108. The normal batch level is shown at 144, whereas a layer of aerated material 142 extends higher and additional aeration 132A occurs under intensifier assembly 108. Because of the pitch provided in the L shaped rod, solid material will be thrown or projected towards the common juncture plane 14 as shown at 134 of FIG. 5A, as the intensifier rotates. However, due to rotation of the shell, when the apex of the blender is in its lower most position, the projected material will be deflected off the wall 150 of leg 10, as shown at 134 of FIG. 5A. This deflected material will thus be displaced away from the common juncture plane 14 because of the slope and position of the wall 150.

In the operational diagram of FIG. 5B, the apex of the blender has been displaced or turned 180° and is shown in its upper most position. An aeration layer 140 extends above batch level 138 and aeration 132B occurs under intensifier assembly 108. The L shaped rods of intensifier 108 now project material towards and across the common juncture plane 14. The projected material 136 is thrown across the common juncture 14 into leg 12. That is, the rotation of the shell consisting of legs 10 and 12 has displaced the wall 150 from the path of the projected material. It will thus be appreciated that, although the L shaped pitched dispersion rods always throws the material with a component in the direction of the common juncture plane 14, the rotation of the shell and specifically the slope of wall 150 will translate this motion so as to have components in both directions along the axis of rotation 90. The intensifier 108 will effectively move material in both directions along the center line or rotational axis 90 because of the deflection of material by wall 150. It should further be appreciated that the flow pattern of the solid material in the shell changes gradually as the shell rotates between the extreme positions shown in FIGS. 5A and 5B, thus redistributing the projected material continuously along the axis of rotation 90 through out both legs even though the intensifier is located exclusively on one side of the common plane of juncture of the legs.

As intensifier 108 is rotated 180 degrees about rotational axis 90 the positions of the L shaped rod heads 124B and 124A will simply be interchanged. In other words, each dispersion rod head will track and other head. Since the straight dispersion rods 114A and 114B will also track each other, the intensifier assembly 108 may be said to be axially symmetric. That is, each circumferential point on the intensifier 108 will be following the path of a different part of the intensifier. This property is extremely useful in lowering the power consumption of the blender. The disadvantage of having this kind of axially symmetry on such an intensifier is that it might be expected to project the materials in only one axial direction and indeed, the pitched L shaped rods of the present invention always project the material with a component in the direction of the common juncture plane. However, because of the synergistic interaction with the rotation of the shell, and specifically the deflection of material by the wall of the shell, the material is distributed by the L shaped rods axially in both directions from the intensifier.

Although only one form of the invention has been shown and described in detail, it will be readily apparent to those skilled in the art that various changes may be made therein without departing from the true spirit or full scope of the invention for which reference should be made to the appended claims.

I claim:

1. A blending apparatus comprising a material container including a pair of hollow blending legs joined together at one end along a common plane to form an apex portion, said hollow legs defining an interior blending space and being divergent from said common plane along intersecting axes each of which forms an acute angle with said common plane, means for mounting said container for rotation about a rotation axis in the plane of the intersecting axes of said legs, means for rotating said container about said rotation axis whereby said apex portion repetitively moves between an uppermost position and a lower most position, an intensifier assembly in said interior blending space for blending different materials placed in said interior blending space, an intensifier drive shaft for rotating said intensifier assembly about said rotation axis, said intensifier assembly having a disc assembly and at least two L-shaped rods arranged to displace material towards said common plane upon rotation of said assembly, such that whenever said apex portion is at an uppermost position, the intensifier assembly throws said displaced material across said common plane, and whenever said apex portion is at its lowermost position, the intensifier throws said displaced material into contact with a wall of said material container, the contact occurring before the material has reached said common plane and causing the material to be deflected away from said common plane and said intensifier assembly is symmetric with respect to the axis of rotation, said L-shaped rods being supported at an end of the intensifier assembly remote from said intensifier drive shaft, said intensifier assembly further including at least first and second straight dispersion rods adjacent the end of the intensifier assembly connected to the intensifier drive shaft, the straight dispersion rods being colinear with each other and coplanar with the shafts of the L-shaped rods.

2. The blending apparatus of claim 1 wherein said intensifier assembly is located exclusively on one side of said common plane.

3. The blending apparatus of claim 1 wherein said intensifier assembly further includes a plurality of channel outlets for allowing liquid to flow through and mix with material in the material container.

4. The blending apparatus of claim 1 wherein the container is shaped to block the passage of a variable portion of material across the common plane as the intensifier assembly is rotated, the variable portion changing gradually as the container rotates.

5. The blending apparatus of claim 1 wherein said disc assembly further includes a plurality of channel outlets for allowing liquid to flow through and mix with material in the material container.

6. The blending apparatus of claim 6 wherein said plurality of channel outlets are disposed around the circumference of the disc assembly and extend radially from said axis of rotation.

7. A blending apparatus comprising a material container including a pair of hollow blending legs joined together at one end along a common plane to form an apex portion, said hollow legs defining an interior blending space and being divergent from said common plane along intersecting axes each of which forms an acute angle with said common plane, means for mounting said container for rotation about a rotation axis in the plane of the intersecting axes of said legs, means for rotating said container about said rotation axis whereby said apex portion repetitively moves between an uppermost position and a lower most position, an intensifier assembly in said interior blending space and located exclusively on one side of said common plane for blending different materials placed in said interior blending space, intensifier drive shaft means for rotating said intensifier assembly about said rotation axis, said intensifier assembly including a disc assembly and at least two L-shaped rods arranged to displace material towards said common plane upon rotation of said assembly such that whenever said apex portion is at an uppermost position, the intensifier assembly throws said displaced material across said common plane, and, whenever said apex portion is at its lowermost position, the intensifier throws said displaced material into contact with a wall of said material container, the contact occurring before the material has reached said common plane and said intensifier assembly is symmetric with respect to the axis of rotation, said disc assembly having a plurality of channel outlets around the circumference thereof and extending radially from said axis of rotation to allow liquid to flow through and mix with material in the material container, said intensifier having one end connected to the intensifier drive shaft means and another end remote therefrom, said L-shaped rods being supported at the end of the intensifier assembly remote from said intensifier drive shaft and said intensifier assembly further including at least first and second straight dispersion rods adjacent the end of the intensifier assembly connected to the intensifier drive shaft, the straight dispersion rods being colinear with each other and coplanar with the shafts of the L-shaped rods.

8. The blending apparatus of claim 7 wherein said means for rotating said container includes a container drive shaft and said intensifier drive shaft is coaxial with said container drive shaft.

9. The blending apparatus of claim 8 wherein the head of each L-shaped rod is at an angle of 45° with respect to the plane defined by the axis of rotation and the shafts of the L-shaped rods, each L-shaped rod adapted to displace material towards said common plane when said intensifier assembly is rotating, whereby the displaced material coacts with an inner wall of said material container, the degree of coaction between the displaced material and the wall at any particular point in time being dependent on the position of the apex portion at that point in time.

10. The blending apparatus of claim 7 wherein the container is shaped to block the passage of a variable portion of material across the common plane as the intensifier assembly is rotated, the variable portion changing gradually as the container rotates.

11. The blending apparatus of claim 7 wherein said at least two L-shaped rods have colinear shafts, said shafts extend radially out from said intensifier axis and each L-shaped rod has a head which extends outwardly at an angle from the plane defined by the axis of rotation and the shafts of the L-shaped rods.

12. A blending apparatus for liquids and solids comprising:

a material container having an interior blending space divided by a common plane, an intensifier assembly located exclusively on one side of said plane, an intensifier drive shaft for rotatably supporting said intensifier assembly within said interior blending space, a container drive shaft for rotating said container about a horizontal axis of rotation, said drive shafts being coaxial, said intensifier assembly being symmetric with respect to the axis of rotation and including at least first and second L-shaped rods each having a shaft extending radially from the axis of rotation and a head at an oblique angle with respect to a plane defined by the axis of rotation and the shaft, the shafts of said L-shaped rods being colinear and perpendicular to said axis of rotation and the heads being arranged on opposite sides of the plane defined by the axis of rotation such that the oblique angle formed by each head has the same absolute value, and said intensifier assembly further including a disc assembly having a plurality of radial channel outlets extending to the periphery thereof for allowing a source of liquid connected to said assembly to flow through and mix with material in the material container, a liquid feed tube extending through said intensifier drive shaft for providing liquid to the inside of the intensifier assembly, said intensifier drive shaft being arranged to extend into said intensifier assembly at one end only, said L-shaped rods being disposed at an end of the intensifier remote from said intensifier drive shaft and said intensifier including first and second straight rods at the end of the intensifier adjacent the intensifier drive shaft, said straight rods being colinear with each other and coplanar with the shafts of the L-shaped rods.

13. The blending apparatus of claim 12 wherein said material container includes a pair of hollow mixing legs joined together at one end along the common plane to form an apex portion, said hollow legs being divergent from said common plane along intersecting axes each of which forms an acute angle with said common plane, and further comprising, means for mounting said container for rotation about said axis of rotation, said axis of rotation being in the plane of the intersecting axes of said legs, and means for rotating said container about said axis of rotation, and wherein said first and second oblique angles have the same absolute value.

14. The blending apparatus of claim 12 wherein said L-shaped rods project materials towards said common plane whereby:

said materials are thrown across said common plane whenever said apex portion is at its uppermost position, and, said materials are deflected away from said common plane by contacting an inner wall of said material container whenever said apex is at its lowermost position.

* * * * *

UNITED STATES PATENT AND TRADEMARK OFFICE

CERTIFICATE OF CORRECTION

PATENT NO. : 4,368,986

DATED : January 18, 1983

INVENTOR(S) : John J. Fischer

It is certified that error appears in the above-identified patent and that said Letters Patent are hereby corrected as shown below:

In Claim 6, column 9, line 7, after "Claim", "6" should be --5--.

Signed and Sealed this

*Fifth* Day of *April 1983*

[SEAL]

*Attest:*

GERALD J. MOSSINGHOFF

*Attesting Officer*

*Commissioner of Patents and Trademarks*